United States Patent [19]

Gökcen

[11] Patent Number: 4,480,592

[45] Date of Patent: Nov. 6, 1984

[54] DEVICE FOR CONVERTING ENERGY

[76] Inventor: Mehmet R. Gökçen, Esentepe, Emekli Subay Evleri 17 Blok, Daire 9, Gayrettepe, Istanbul, Turkey

[21] Appl. No.: 445,450

[22] Filed: Nov. 30, 1982

[51] Int. Cl.[3] ..... F22B 3/06; F28C 3/00

[52] U.S. Cl. ..... 122/26; 122/40; 126/247

[58] Field of Search ..... 122/26, 40; 126/247

[56] References Cited

U.S. PATENT DOCUMENTS 4,277,020 7/1981 Grenier ..... 122/26

4,325,354 4/1982 Fuchs ..... 122/26 X 4,381,762 5/1983 Ernst ..... 122/26

4,388,915 6/1983 Shafram ..... 122/26

*Primary Examiner*—Edward G. Favors

*Attorney, Agent, or Firm*—Shapiro and Shapiro

[57] ABSTRACT

A mechanical device imparts a circular rotational movement to a liquid and at various stages of the movement exerts variable vacuum and pressure effects on the rotating liquid to convert potential energy into heat energy.

Preferably employs a centrifugal energy drum (B) and a channelled guide disc (C) arranged in a device body (A) and supported by a chassis (D).

18 Claims, 4 Drawing Figures

DEVICE FOR CONVERTING ENERGY

The present invention relates to a device for converting the potential energy existing between the molecules of fluid substances into heat energy.

An object of the invention is to provide a device (or heat pump) suitable for application to all kinds of hot water and steam boilers, and to provide considerable savings in the use of energy producing raw materials such as fuel oils, coal, wood, etc., thus reducing pollution, and producing heat energy with minimum electrical energy consumption.

According to the invention, there is provided a device for converting the potential energy existing between the molecules of fluid substances into heat energy, characterized in that a circular rotational movement is imparted to the liquid in the device and at various stages of such movement, variable vacuum and pressure effects are exerted on the liquid mass rotating within the device.

The device provided by this invention provides the utilization, as raw materials from which energy is produced, of fluids such as water and air which are already freely available in nature in abundant quantities.

As a natural consequence thereof, the use of raw material sources such as petroleum, coal, wood, dung, etc. which are being used for producing heat energy and which are difficult, dangerous and expensive to produce, transport, store and handle, becomes unnecessary and thus the problem of pollution is solved on a large scale and permanently. The heat pump which is the subject matter of this invention is generally adaptable to hot water and steam boilers for all purposes.

Accordingly, it can easily be used in the central heating systems of houses, and will ensure considerable convenience in collectively heating places such as cities, districts, and housing collectives.

Also, since its application to steam boilers will enable the erection of regional electric power plants, such very difficult, expensive and dangerous work as big central production installations like hydroelectrical, thermoelectrical and atomic power plants as well as the construction, maintenance and repairs of the networks necessary for electrical transmission, will have been avoided.

Since the adaptability of the heat pump provided by the invention to all types of steam boilers will save sea vessels from storing and transporting raw materials, the space previously required for this can be allocated for freight and thus, in addition to fuel saving, an additional economy will be secured in transportation.

The device of the invention for generating heat so far as its general appearance is concerned, is a mechanical system analogous to a centrifugal pump.

Therefore, the device is filled with the most suitable liquid. Suction and pressure pipes are connected to a boiler to be heated or, in the case of indirect heating, to the two ends of the serpentine circuit similar to a pump so as to form a closed circuit. A device according to the invention, operated by means of engine power, looks exactly like a motor pump and, subjecting the sucked liquid to a heating process, heats it without its own structure and in a form heated to a higher value than the inlet heat, supplies it to the boiler (or to the serpentine circuit) through the pressure pipe.

The heat pump enabling the utilization of fluids as raw materials in producing heat, has been realized on the basis of the following known facts:

1. Minute particles of air, under the effect of atmospheric pressure, settle within the liquid in the form of small bubbles not visible to the naked eye and this physical phenomenon, which is entirely natural, is hereinafter referred to as "melted air".

2. Through heating of water, the volume of such air bubbles expands in direct proportion to the heat applied and thus, equilibrium being upset, they leave the liquid;

And even, in place of such air bubbles leaving the liquid by rupturing the surface of the liquid, masses of cold air enter the liquid through the same rupture, and thus cause certain points of boiling.

3. It is also known that air masses expanding as they are heated, combine within the liquid and form larger bubbles and when the boiling point is reached, their volume increasing extremely, while rupturing the surface of the liquid through the large carrying power they gain, they also carry the water masses adhering to their walls to the atmosphere in the form of evaporation.

4. It is also known that the quantity of melted air or melted gas within the liquids may be increased in relation to the pressure exerted on the liquids, that is to say by exerting high pressure more air and gas can be inserted into the structure of liquids.

5. It is also known that the quantity of melted air or melted gas contained in the liquids under normal atmospheric pressure, provides an elasticity to the liquids in which they are contained, although such an elasticity may be negligible in calculations, and that such an elasticity increases in proportion to the temperature of the liquid.

As a matter of fact, this phenomenon has led to the use of expansion tanks in the central heating systems which can be clearly observed from the increase in the levels of water in such tanks.

6. Air and gasses have far greater expansion capabilities as compared to that of liquids.

Therefore, they provide elasticity commensurate with their quantity and heating degree to the liquid in which they are dissolved.

As a consequence thereof, starting from the fact that the liquid pressure is the factor increasing the amount of melted air in the liquid, and as soon as the pressure on the liquid is removed excess air leaves the liquid; that external pressure exerted on the liquids compresses the melted air masses thus reducing their volume and creating an internal pressure and thus internal and external pressures are equalised at a certain level, it has become possible to elasticize the liquids at a desired rate by means of a specially arranged mechanical system which ensures control of the internal pressure by control of the external pressure.

7. A common fact for all materials is that the potential energy existing between the molecules of the substance and which is observed as adhesion power, is converted to heat energy where the natural distance between the molecules is subjected to change.

As a matter of fact this is evidenced by the heat phenomenon produced when a copper wire is stretched by pulling it from both ends or when a metal is formed by forging.

Also, the same is observed with air and gasses compressed in a piston pump.

8. As the same is valid also in the case of liquid substances, by increasing-decreasing the volume of air and gas masses which may be introduced into the liquid structure at any desired proportion by increasing pressure or which may already exist in the liquid structure, it is possible to bring closer together and to separate the liquid molecules, and thus, to liberate the potential energy existing between the liquid molecules and convert it into heat energy.

In view of the foregoing facts, the heat pump provided by the invention realizes the heating effect by converting the liquids into elastic fluids and by creating periodically alternating vacuum and pressure effects on such fluid mass.

The invention will now be described in more detail with reference to the accompanying drawings in which.

The device, so far as its general appearance is concerned, is a mechanical system of the type of a centrifugal pump, consists of four main groups, namely body A, centrifugal energy drum B, channelled guide disc C and chassis D.

The body A contains the rotating centrifugal energy drum B and the channelled guide disc C and functions as liquid storage unit.

The centrifugal energy drum B consists of a disc rotatable around the central axis and capable of creating centrifugal energy by rotating the liquid mass by means of closed fins B/2.

The closed fins B/2 arranged within the centrifugal energy drum B for imparting rotational movement of the liquid therein not only rotate the liquid within the pump but also exert a vacuum pressure sequence on the rotating liquid mass and ensure the maintenance of said vacuum pressure sequence throughout the operation of the pump.

Figure 2:
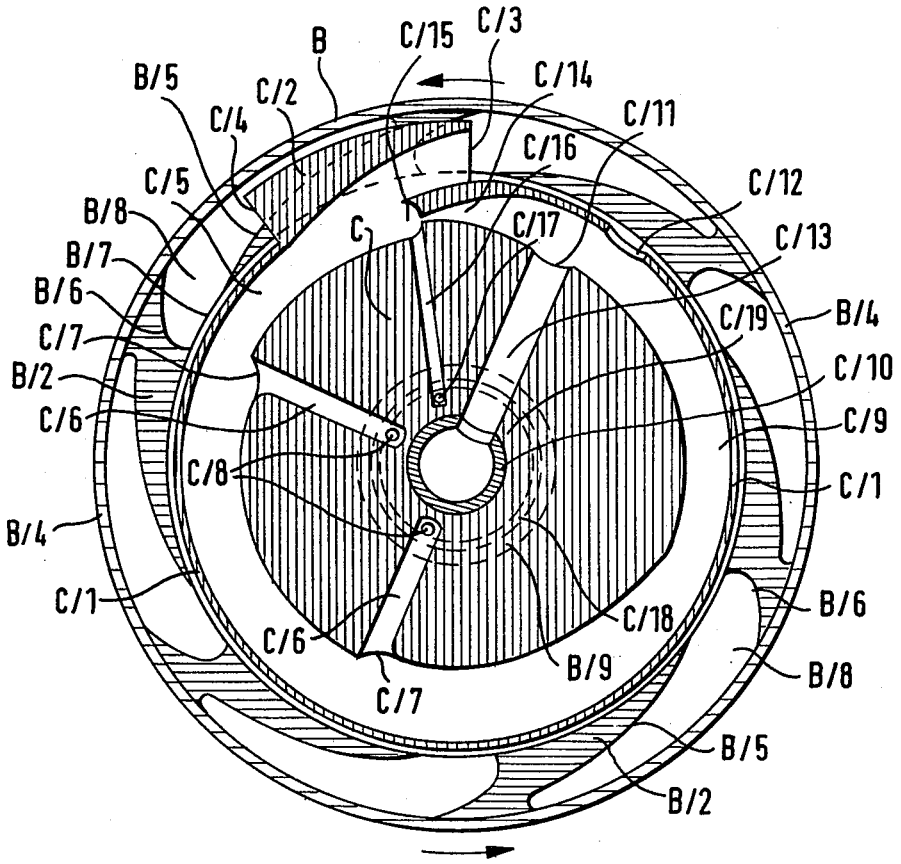
FIG. 2 shows in vertical cross-section a centrifugal energy drum and a channelled guide disc within the former, which are the main elements of the device.
Figure 3:
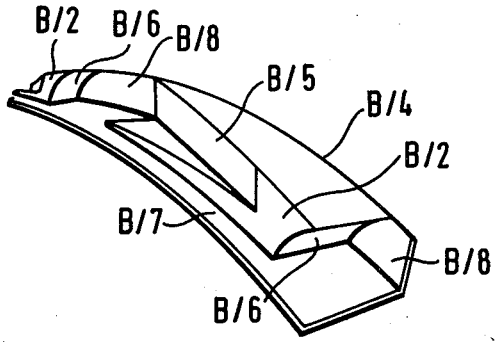
FIG. 3 shows three-dimensional drawing of closed fins.
Figure 4:
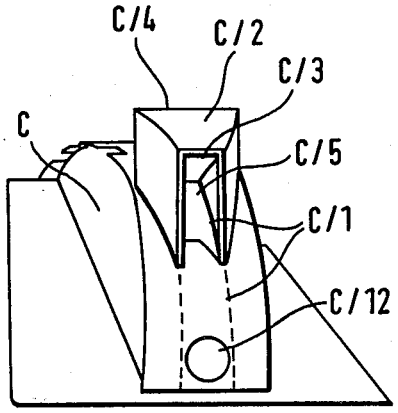
FIG. 4 shows three-dimensional drawing of multi-functional head.

The channelled guide disc C consists of a disc arranged in the interior of the centrifugal energy drum B and on the same axis therewith and fixed to the body A by means of a pressure pipe C/10. It is a disc provided externally with a sufficient number of multi-function heads C/2 and internally (as seen in FIG. 2) with a tube ring C/1 and various channels and orifices.

Accordingly, the channelled guide disc C also has two functions, namely:

To separate the liquid to be fed outside the heat pump from the liquid to remain within; and To exert a continuous and variable vacuum pressure sequence on the liquid subjected to a rotational movement similar to the one as in the case of the centrifugal energy drum B, also in the channelled guide disc C.

Channelled guide disc C has been designed as follows in order to create its vacuum pressure sequence:

The channelled guide disc C by means of multi-function head C/2 arranged on the external surface thereof simultaneously carries out the following four functions:

(a) Separation into three individual rings of the liquid mass rotating within the centrifugal energy drum B;

(b) Passing the central ring into the tube ring C/1 through inlet C/3;

(c) Compressing the liquid rings remaining on two sides of the inlet C/3 towards the fin ladles B/6; and (d) Creating a vacuum area behind the head base C/4.

The chassis D supports the body A of the heat pump and through a main shaft B/1 connects the centrifugal energy drum B arranged within the former to the motive power center E and communicates with the heat boiler or serpentine system as required.

The above-disclosed device which is completely filled with liquid, starts operation by the drive force imparted by the power center E to which it is connected.

Figure 1:
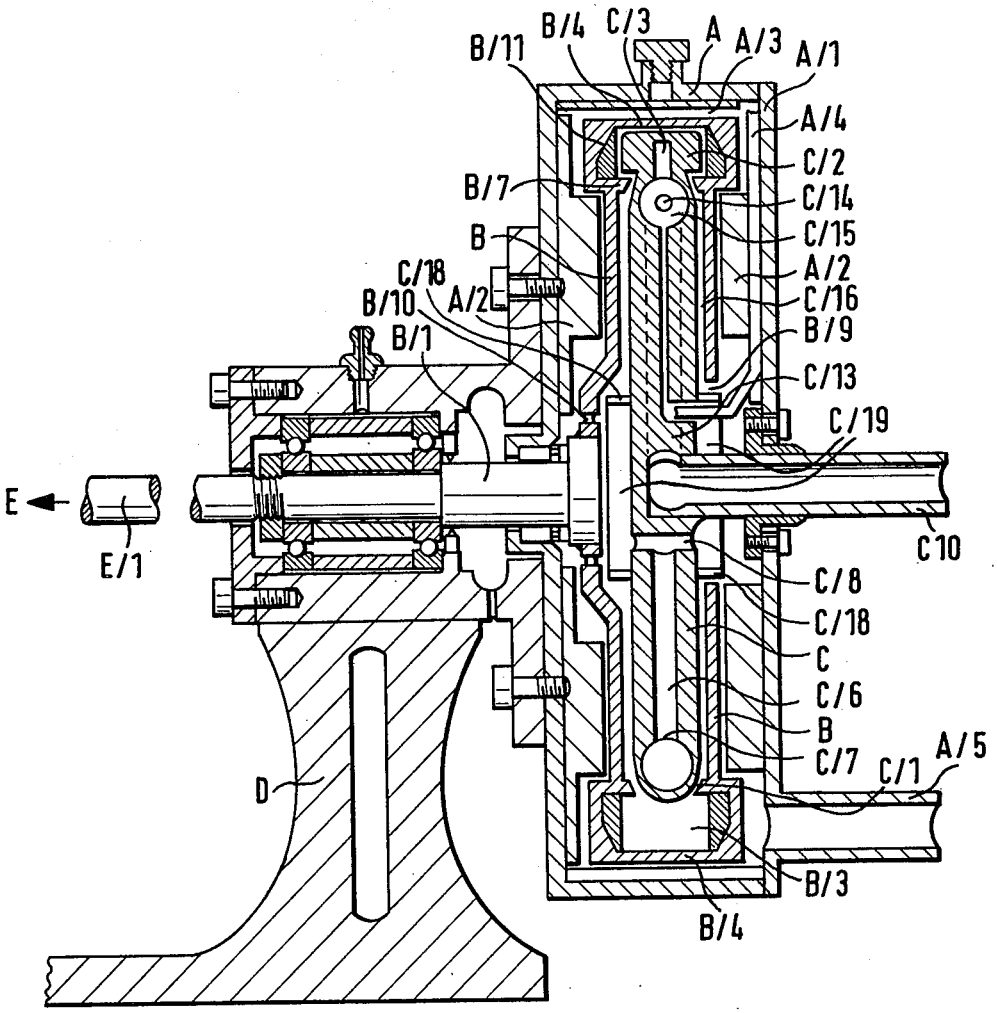
FIG. 1 shows in vertical cross-section the complete device composed of four main groups.

Through the effects of the following phenomena taking place within it, and by liberating the potential energy existing between the molecules of the fluid it contains, the device converts the energy into heat energy as follows:

As seen in FIG. 1, the movement of the driving power center E is transmitted to the centrifugal energy drum B attached to the main shaft B/1.

During the rotation of the centrifugal energy drum B the liquid mass also is entrained and starts rotating by means of the closed fins B/2 arranged on the internal surfaces.

As this rotational movement will impart a centrifugal power to the liquid within the centrifugal energy drum B, a pressurized liquid ring is formed within the annular liquid chamber B/3.

The important characteristics of said liquid ring are that, since it is subject to the inertia due to gravity on the one hand to the braking phenomenon of the friction effect created by the multi-function head C/2 in the middle section of the centrifugal energy drum B and within the liquid ring on the other hand, it always has to move so as to be slower than the speed of the closed fins B/2. Therefore, as the movement of the closed fins B/2 located on both sides of the liquid ring, which movement is faster than the movement of the liquid mass, will cause liquid resistance on the inclined fin surfaces, liquid masses within the fin spaces B/8 will be vigorously pushed from both sides of the annular liquid chamber B/3 in a manner to be deflected towards the central section.

This phenomenon of deflecting the liquid masses from the sides towards the central section will create an additional pressure increase in the central section of the liquid ring in addition to the liquid pressure which is produced by the existing centrifugal force.

It is obvious that this deflection phenomenon furthermore, will facilitate near the side surfaces of the liquid ring (and particularly behind the fin ladles B/6) the creation of a low pressure volume formed due to the liquid mass being unable to reach the fast moving closed fins B/2.

In line with the above phenomenon, rotational power is being transmitted from the centrifugal energy drum B to the liquid ring, and consequently overcoming the braking effect arising from the gravity inertia and friction losses, assures a stable rotational speed of the liquid ring.

Thus, the liquid mass, which has acquired momentum due to a specific and stable speed, imparts a continuous impelling effect on the front surface of the multifunctional head C/2 staying fixedly therein, and consequently a separate pressure is created in addition to the existing centrifugal pressure on the surfaces on which the liquid impacts.

The liquid rings impacting at high speed on the thrice twisted frontal face of the multi-functional head C/2, which is continuously subject to passage of liquid, will be divided into three liquid rings as if cut by the stroke of a knife.

Of these rings, as the one in the middle section will coincide with the inlet C/3, by all its force it will enter through the permanently open inlet C/3 and penetrate into the tube ring C/1.

Meanwhile, the other liquid rings on either side will continue progressing on their path within the annular liquid chamber B/3 in a gradually diverging manner towards the head base C/4 in conformity with the inclined side surfaces of the multi-functional head C/2.

However, since the external side surfaces of these two side liquid rings, (two side walls of the annular liquid chamber B/3), are bound by the drum pulley B/4 on the upper surface and by the fin closing ring B/7 on the lower surfaces, the liquid masses forming such rings will be forced into gradually decreasing volumes by the multi-function head C/2.

As this decrease of volume will be at its minimum on the level of the head base C/4, the pressures of such side liquid rings will also reach a maximum level at this point.

Thus, it has become possible by means of the multi-functional head C/2 to introduce liquid mass into the low pressure regions formed behind the fin ladles B/6 due to their faster movement than the liquid mass. While these phenomena take place in the front part of the multi-functional head C/2, a large low pressure region forms at the rear part and in front of the head base C/4.

This specially designed large low pressure region, influencing the fin spaces B/8 level therewith and filled with pressurized liquid, instantaneously relieves the pressure of the high pressure liquid in these regions.

Thus, by means of these vacuum regions, arranged both in the sections of fin ladles B/6 and head base C/4, a pressure reducing action is enforced on the liquid masses passing on their level.

This pressure reducing action, through the aid of multi-function head C/2, has been effected by the high pressure action defined as above, on the fin spaces B/8 passing on the same level.

Thanks to this effect, as long as the device is in operation, the liquid mass in the section of the annular liquid chamber B/3, is subjected periodically to a vacuum pressure sequence of events.

As a consequence thereof, it is possible to subject the melted air and melted gas masses already present in the liquid material introduced into the device, to a change of volume in a continuous manner and thus provide structural dynamism to the liquids.

Furthermore, taking advantage of this dynamism, it has also been possible to introduce more air or gas masses into the structure of liquids, and consequently to maximize the elasticity of liquids used in heat pump and thus, to increase the heat producing capabilities of the heat pump.

The same events and results are achieved also within channelled guide disc C but repeated in a different manner.

As a matter of fact, apart from the special functions of the channelled guide disc C such as providing excess air to the system, adjustment of required internal displacement and discharging the heated liquid from the system which are functions of the device, while realizing the vacuum effect at the pulverizing chamber C/15 and suction inlets C/7; and high pressure effect at the inlet neck C/5, pressure neck C/9 and double function orifice C/14, on the level of the regulator inlet C/12, within the tube ring C/1 it provides sudden pressure decrease and within the annular liquid chamber B/3 it provides sudden pressure increase.

Although these events within the channelled guide disc C take place simultaneously, in order to provide simplicity in description, the sequence of events is based on the movement of the liquid first entering through the inlet C/3, namely:

Liquid mass entering the channelled guide disc C through inlet C/3 with the momentum it gained in annular liquid chamber B/3 pushing the liquid in front, it proceeds along its path by entering the inlet C/5 and thence is channelled through tube ring C/1.

As the rotational movement of liquid mass within tube ring C/1 will continue as a result of support on the external periphery thereof, the pressure of the liquid ring formed within the tube will be high on the external periphery and at minimum level on the internal circle.

This facilitates the pressure decrease action taking place at suction inlet C/7 section through the entraining effect of the liquid flow within the tube ring C/1.

Also, such a pressure drop produces a suction effect on liquid masses both in the tube ring C/1 and suction channels C/6.

Consequently, melted air particles contained in said liquid masses become subject to expansion.

This expansion moves liquid particles away from each other. Accordingly, liquid molecules contained in separate liquid particles also move away from each other.

The suction effect causing the above phenomena simultaneously displaces the liquid masses within the suction channels into the tube ring C/1.

Thus, while the amount of liquid entering from inlet C/3 to tube ring C/1 is increased, the elasticity of the liquid within the tube ring C/1 is increased in conformity with its more expanded pattern until the pressure neck C/9.

As this elastic fluid mass, which is continuously pushed from inlet C/3 into tube ring C/1, will be forced into the conically narrowing pressure neck C/9, it becomes subject to considerable volume decrease in this section, and consequently the pressure of the liquid increases considerably.

As this increased pressure will compress the melted air particles, similar to the air compressed in a piston pump, it will also lead to an increase of heat. That is to say, this heat produced in the air particles, will be transferred also to the immediately adjacent and contacted liquid particles, and the general heat of the fluid also will increase.

This increased heat, by increasing the expansion, will double the flow speed which already has increased in the pressure neck C/9.

Sudden pressure drop to be encountered by the fluid mass progressing under high internal pressure and increased speed at the tension regulating inlet C/12 arranged along its path, will lead, towards the inside of the annular liquid chamber B/3, to a volume expansion in the form of a burst.

This forced and vigorous displacement into the annular liquid chamber B/3, like a sudden shock, will also increase the pressure of the liquid ring.

This action, while compressing air particles within liquid ring by way of pressure increase, will also cause volume expansion in tube ring C/1.

Thus, the reverse of the action which takes place in the annular liquid chamber B/3 occurs in this section of the tube ring C/1 and liquid masses move away from each other.

The tension regulator inlet C/12 causing the above phenomena also contributes to the heat production in both sections by performing an important function in the vacuum pressure sequence.

The fluid mass continuing its progress from the tension regulator inlet C/12, with all its speed and power, passes to the double function orifice C/14 located in its direction of movement.

Fluid mass which can pass through the said double function orifice C/14, with its considerably increased speed, is added, with an intensive impact from the rear, to the fluid mass entering in the direction of the inlet neck C/3 and from the inlet C/5.

During this jetting action, a pressure drop takes place in the pulverizing chamber C/15. This effect, in turn, sucks the air masses contained in the carburetor channel C/16 and causes entrainment thereof by the fluid jetting from the double function orifice C/14 and forced introduction into the inlet neck C/5.

Thus, the function of addition of air in a quantity sufficient to saturate the liquid mass subjected to processing in the heat pump in proportion to the high pressure will have been realized.

This heated fluid mass passing through double function orifice C/14 not only adds excess air and imparts impelling power to the liquid mass entering the tube ring C/1 from inlet neck C/3, but also adds to it heat energy.

While these phenomena take place ahead of the double function orifice C/14, the fluid mass unable to proceed further, is transferred from the pressure neck C/11 to the pressure channel C/13 and through the pressure pipe C/10 is discharged from the pump.

To the centrifugal energy drum B evacuated by the fluid discharged from the heat pump, is displaced the liquid contained in the body A through external suction channel B/9 and displacement channels B/10.

In this case, as the pressure drop will have been transferred to the body A, liquid is sucked from the suction pipe A/5 into the pump and thus the circuit is completed.

By means of a boiler included within such a formed closed circuit, it is possible to produce heat energy in a most economical manner.

For ease of reference, the following is a list of component parts shown in the drawings:

| | | | | | |
|---|---|---|---|---|---|
| 1. | Body | (A) | 21. | Multi-Function Head | (C/2) |
| 2. | Lid | (A/1) | 22. | Inlet | (C/3) |
| 3. | Stop Fins | (A/2) | 23. | Head Base | (C/4) |
| 4. | Body Chamber | (A/3) | 24. | Inlet Neck | (C/5) |
| 5. | Carburettor Pipe | (A/4) | 25. | Suction Channels | (C/6) |
| 6. | Suction Pipe | (A/5) | 26. | Suction Necks | (C/7) |
| 7. | Centrifugal Energy Drum | (B) | 27. | Suction By-Pass | (C/8) |
| 8. | Main Shaft | (B/1) | 28. | Pressure Neck | (C/9) |
| 9. | Closed Fins | (B/2) | 29. | Pressure Pipe | (C/10) |
| 10. | Annular Liquid Chamber | (B/3) | 30. | Pressure Neck | (C/11) |
| 11. | Drum Pulley | (B/4) | 31. | Tension Regulator | (C/12) |
| 12. | Fin Upper Surface | (B/5) | 32. | Pressure Channel | (C/13) |
| 13. | Fin Ladle | (B/6) | 33. | Double-Function Orifice | (C/14) |
| 14. | Fin Closing Ring | (B/7) | 34. | Pulverizing Chamber | (C/15) |
| 15. | Fin Spaces | (B/8) | 35. | Carburetor Channel | (C/16) |
| 16. | External Suction Channel | (B/9) | 36. | Joint Elbow | (C/17) |
| 17. | Displacement Channel | (B/10) | 37. | Dividing Ring | (C/18) |
| 18. | Drum Internal Walls | (B/11) | 38. | Central Liquid Chamber | (C/19) |
| 19. | Channelled Guide Disc | (C) | 39. | Chassis | (D) |
| 20. | Tube Ring | (C/1) | 40. | Motor | (E) |
| | | | 41. | Rotor Shaft | (E/1) |

I claim:

1. A device for converting the potential energy existing between the molecules of liquid into heat energy, comprising a body member for containing liquid, and means including a centrifugal energy drum mounted for rotation within said body member and adapted to receive liquid therein, and a channelled guide disc arranged within said drum, for imparting circular rotational movement to liquid contained in said drum and, by virtue of the cooperation of said drum and said channelled guide disc, for exerting, at various stages of said rotational movement, variable vacuum and pressure effects on the rotating liquid that heat the liquid.

2. A device according to claim 1, wherein drive means is provided for rotating said drum and imparting said rotational movement.

3. A device according to claim 2, wherein said channelled guide disc is fixed to said body member.

4. A device according to claim 3, wherein said channelled guide disc has pressure channel means therein for discharging heated liquid from said body member.

5. A device according to claim 3, wherein said channelled guide disc has carburetor channel means therein for supplying outside air to the rotating liquid.

6. A device according to claim 3, wherein said channelled guide disc has a tube ring therein and has multifunction external head means comprising an inlet neck and a head base.

7. A device according to claim 6, wherein the centrifugal energy drum has fin means for imparting rotational movement to liquid in said drum, said fin means having fin ladles.

8. A device according to claim 7, wherein the multifunction head means performs the following four functions simultaneously:

(a) separating rotating liquid within the centrifugal energy drum into a central ring and a pair of side rings;

(b) receiving the central ring through the inlet neck and directing the same into the tube ring;

(c) compressing the side rings at opposite sides of the inlet neck toward the fin ladles; and (d) creating a vacuum area behind the head base.

9. A device according to claim 6, wherein the multifunction head means is on the path of liquid rotating within the centrifugal energy drum and is disposed to provide a barrier which allows liquid passage only around the head base for providing a permanent vacuum region within the rotating liquid behind the head base.

10. A device according to claim 4, wherein a tube ring is provided in the channelled guide disc for supplying liquid from said drum to the pressure channel means through a pressure neck, the tube ring communicating with suction inlets of suction channels and having a diameter that increases in the direction of liquid flow therein and then decreases at the pressure neck in order to create a vacuum and pressure sequence in liquid entering the tube ring.

11. A device according to claim 10, wherein tension regulator hole means is provided in the tube ring communicating with the centrifugal energy drum after the pressure neck and opposite the pressure channel means for creating a pressure drop at the pressure neck by transmitting to liquid rotating within the centrifugal energy drum excess pressure of the liquid within the tube ring, the pressure of which increases after it has entered the pressure neck.

12. A device according to claim 11, wherein orifice means is provided at an exit end of the tube ring for causing an accelerated column of liquid that has passed the tension regulator hole means to impact behind incoming liquid from the centrifugal energy drum to the tube ring.

13. A device according to claim 10, further comprising suction by-pass means for directly introducing liquid into the tube ring.

14. A device according to claim 3, further comprising fin means arranged on opposite surfaces of the interior of the centrifugal energy drum for causing rotation of liquid within the drum and for creating variable vacuum and pressure effects on the rotating liquid in the drum.

15. A device according to claim 14, wherein the fin means comprises fins with upper surfaces, ladles, a fin closing ring, and fin spaces.

16. A device according to claim 15, wherein the fin means perform the following three functions simultaneously:

(a) imparting rotational movement to liquid within the centrifugal energy drum and maintaining that movement;

(b) adding supplemental pressure to the pressure created by centrifugal force on the rotating liquid by sweeping the rotating liquid on both sides of an annular liquid chamber in the drum and impelling the rotating liquid toward the middle of the chamber; and (c) in cooperation with the fin closing ring, creating a vacuum effect at the fin spaces on pressurized liquid rotating within the centrifugal energy drum.

17. A device according to claim 15, wherein the fins are closed at the bottom thereof by the closing ring in a manner preventing liquid from entering the fin spaces.

18. A method of converting the potential energy existing between the molecules of liquid into heat energy, comprising providing a body member containing liquid, providing a centrifugal energy drum containing a portion of said liquid, said drum being mounted for rotation in the body member, providing a channelled guide disc in the liquid in the drum, rotating the drum, and causing the liquid in the drum to rotate in response to the rotation of the drum and, by virtue of the cooperation of the drum and the channelled guide disc, to create variable vacuum and pressure effects in the rotating liquid at various stages of the liquid rotation in order to heat the liquid.

* * * * *